United States Patent [19]

Koeneman et al.

[11] 4,169,617

[45] Oct. 2, 1979

[54] RELEASABLE HOLDING MEANS FOR WINDOW OR SCREEN

[75] Inventors: Paul W. Koeneman, Royal Oak; Peter R. Emanuel, Marine City, both of Mich.

[73] Assignee: International Telephone and Telegraph Corporation, New York, N.Y.

[21] Appl. No.: 894,814

[22] Filed: Apr. 10, 1978

[51] Int. Cl.[2] ..... E05C 1/02

[52] U.S. Cl. ..... 292/149; 49/463; 52/773; 292/256; 292/DIG. 20

[58] Field of Search ..... 292/42, 149, 147, 251, 292/256, DIG. 20, 256.71; 160/369; 49/463; 52/773, 774, 764

[56] References Cited

U.S. PATENT DOCUMENTS

| | | | |
|---|---|---|---|
| 890,062 | 6/1908 | Johnson | 292/DIG. 20 X |
| 1,570,072 | 1/1926 | Merz et al. | 292/DIG. 20 X |
| 3,216,066 | 11/1965 | Hadacek | 292/251 X |
| 3,389,505 | 6/1968 | Zitomer | 49/463 |

FOREIGN PATENT DOCUMENTS

| | | | |
|---|---|---|---|
| 318801 | 7/1902 | France | 292/149 |

*Primary Examiner*—Roy D. Frazier
*Assistant Examiner*—William E. Lyddane
*Attorney, Agent, or Firm*—James B. Raden; Harold J. Holt

[57] ABSTRACT

Means for releasably holding a window or screen in a door frame. The door frame has a continuous flange around an opening to support one side of a window or screen and a plurality of recesses adjacent the opening. A slidable tab within each recess has an elongated slot therethrough and at least two runners on the underside upon which to slide the tab to and from an extended position within the recess. A threaded means passes through the elongated slot in the tab to a threaded hole in the base of the recess to releasably hold the tab in a selected fixed position. The tabs in extended position securely but releasably hold the window or screen against the flange on the frame.

4 Claims, 6 Drawing Figures

RELEASABLE HOLDING MEANS FOR WINDOW OR SCREEN

This invention relates to means for releasably holding a window or screen in a door frame and particularly in the door frame of an all plastic storm door.

A wide variety of holding means are known which function effectively to releasably secure a window or screen to the frame of a storm door. However, none of the known holding means are fully acceptable for releasably holding a window or screen in an all plastic storm door, particularly in a door of the type set forth in copending application Ser. No. 894,813 filed of even date herewith.

It is a primary object of the present invention to provide a releasable holding means for a window or screen which is convenient to use, effective in operation and aesthetically pleasing.

It is an additional object of the present invention to provide a holding means particularly adaptable for releasably holding a window or screen in a plastic storm door.

The holding means of the invention comprises in combination a door frame having an opening to receive a removable window or screen, the frame having a continuous flange around the opening adapted to support one side of the window or screen, a plurality of recesses containing a threaded hole therein, a slidable tab within each recess having an elongated slot therethrough and at least two runners on the underside thereof upon which to slide the tab from a retracted to an extended position, threaded means passing through the elongated slot in the tab to the threaded hole in the base of each recess for releasably holding the tab in a selected fixed position in the recess, the tabs in extended position adapted in combination to securely hold a window or screen against the flange on the frame and adapted in retracted position to release the window or screen.

The invention will be better understood by reference to the attached drawing in which FIG. 1 is an elevational view of the inner surface of the top portion of a storm door showing the holding means of the invention releasably securing a window therein;

Figure 1:
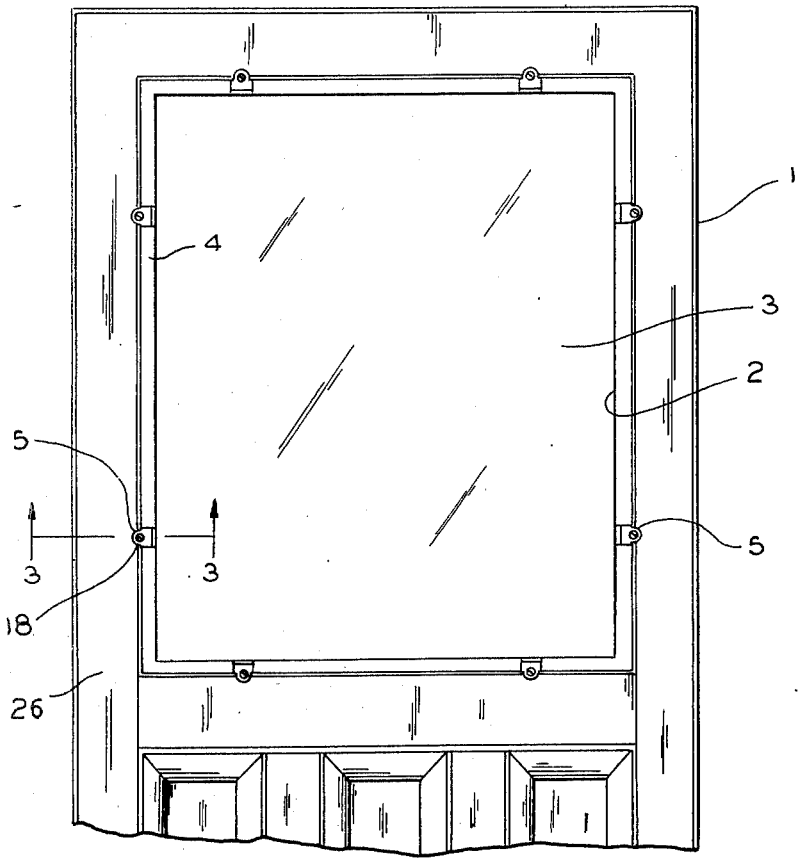
Figure 2:
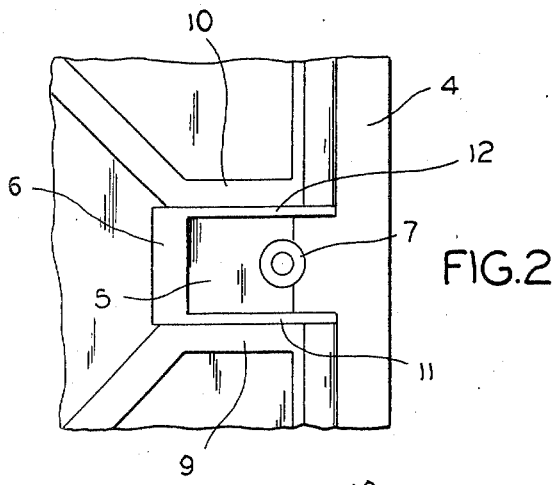
FIG. 2 is an enlarged elevational view of the recess of the holding means of FIG. 1.
Figure 3:
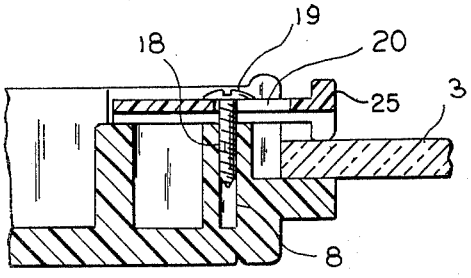
FIG. 3 is an enlarged crossectional view of the holding means along the lines 2—2 of FIG. 1.
Figure 4:
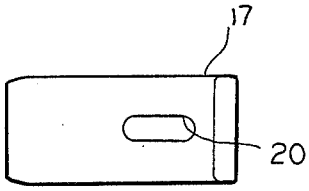
FIG. 4 is an elevational view of the outerside of the slidable tab used in the holding means of FIGS. 1–3.
Figure 5:
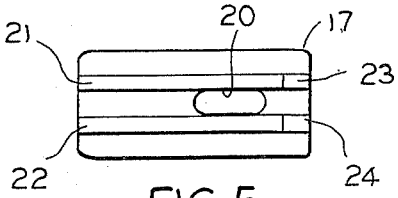
FIG. 5 is an elevational view of the underside of the tab shown in FIG. 4.
Figure 6:
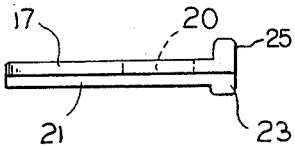
FIG. 6 is a side view of the tab shown in FIGS. 4 and 5.

As shown in the drawing, the releasable holding means comprises a door frame generally identified as 1 having an opening 2 to receive a window 3. The door frame has a continuous ledge or flange 4 around the opening adapted to support one side of window 3. Situated in spaced relationship around the perimeter of and adjacent to the opening 2 are eight identical recesses, identified in the drawing by the numeral 5. As most clearly shown in FIG. 2, the recess 5 contains a back support wall 6, a cylindrical front support 7 containing a threaded hole 8 and two sidewalls 9 and 10 containing shoulders 11 and 12 respectively. The back support wall 6 and front support 7 together from a base for slidably supporting a tab 17. Tab 17 is in turn secured to the recess by a screw 18 having an enlarged head 19 passing through an elongated slot 20 in the tab to the threaded hole 8. The tab has two runners 21 and 22 upon which the tab slides on the base of the recess.

Located at the extremity of each runner are feet 23 and 24 which are adapted to contact the window when the tab is in extended position. On the outerside of the tab, opposite each foot, is a raised rim or flange 25 to facilitate sliding said tab from a retracted to an extended position.

All six recesses of course contain identical tabs and screws. In combination, the eight tabs in extended position securely hold the window against the flange 4 when the screws 18 are tightened. When the screws are loosened and the tabs retracted, the window is released and may be removed or replaced by a screen.

An elongated plastic strip 26 on the storm door partially covers the recess and tab and obscures the recess from view except for the screw 18, access to which is of course necessary. The releasable holding means of the invention is particularly adaptable for use with a plastic door frame of the design and construction disclosed in the aforementioned copending application Ser. No. 894,813. In the preferred construction, the door frame 1, the flange 4, the recess 5 including support walls 6, 7, 9 and 10 are a single molded component of, for example, polystyrene. The tab 17 is also preferably plastic. A particularly suitable plastic is a bearing grade nylon which has a high degree of lubricity and thus is readily slidable in the recess.

We claim:

1. Means for releasably holding a window or screen in a door frame comprising in combination a door frame having an opening to receive a removable window or screen therein, said frame having a continuous flange around said opening adapted to support one side of said window or screen;

a plurality of recesses in said frame adjacent said opening, the base of each of said recesses containing a threaded hole therein;

a slidable tab within each said recess having an elongated slot therethrough and at least two runners extending from said tab on the underside thereof upon which to slide said tab from a retracted to an extended position within said recess, each of said runners containing a foot extending from the extremity thereof adapted to contact the window or screen when the tab is in extended position, each said tab containing a raised rim on the outerside thereof opposite said foot to facilitate sliding said tab to extended position;

threaded means passing through the elongated slot in the tab to the threaded hole in the base of each recess for releasably holding said tab in a selected fixed position in said recess;

said tabs in extended position adapted in combination to securely hold a window or screen against the flange on said frame and adapted in retracted position to release said window or screen.

2. The holding means of claim 1 in which each recess comprises a base, two sidewalls and a partial cover, the cover substantially obscuring the recess from view except for access to said threaded means.

3. The holding means of claim 2 in which the base comprises a back support wall and a front support surface for the runners of said tab, the threaded hole being located in said front support.

4. The holding means of claim 1, 2 or 3 in which said frame is a unitary plastic component.

* * * * *